US011417456B2

(12) United States Patent
Zhang

(10) Patent No.: US 11,417,456 B2
(45) **Date of Patent: *Aug. 16, 2022**

(54) HIGH-VOLTAGE TRANSFORMER AND ELECTRONIC POWER APPARATUS

(71) Applicant: Delta Electronics (Shanghai) CO., LTD, Shanghai (CN)

(72) Inventor: Quanliang Zhang, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 921 days.

This patent is subject to a terminal disclaimer.

(21) Appl. No.: 16/197,784

(22) Filed: Nov. 21, 2018

(65) Prior Publication Data

US 2019/0096567 A1 Mar. 28, 2019

Related U.S. Application Data

(63) Continuation-in-part of application No. 15/869,452, filed on Jan. 12, 2018, now Pat. No. 10,886,054.

(30) Foreign Application Priority Data

Jan. 25, 2017 (CN) ..... 201720104174.1

(51) Int. Cl.
*H01F 27/28* (2006.01)
*H01F 27/36* (2006.01)
(Continued)

(52) U.S. Cl.
CPC ..... *H01F 27/2885* (2013.01); *H01F 27/24* (2013.01); *H01F 27/324* (2013.01);
(Continued)

(58) Field of Classification Search
CPC .... H01F 27/2885; H01F 27/24; H01F 27/288; H01F 27/324; H01F 27/362; H01F 27/363; H01F 27/36
See application file for complete search history.

(56) References Cited

U.S. PATENT DOCUMENTS 4,459,575 A * 7/1984 Geissler ..... H01F 27/306 336/196
4,586,015 A * 4/1986 Takahara ..... H01F 27/36 336/69

(Continued)

FOREIGN PATENT DOCUMENTS

CN 204010993 U 12/2014
CN 204946669 U * 1/2016

(Continued)

OTHER PUBLICATIONS

The USNOA dated Sep. 18, 2020 by the USPTO.

(Continued)

*Primary Examiner* — Elvin G Enad
*Assistant Examiner* — Malcolm Barnes
(74) *Attorney, Agent, or Firm* — Qinghong Xu

(57) ABSTRACT

The present disclosure provides a high-voltage transformer and an electronic power apparatus. The high-voltage transformer includes a magnetic core, a secondary coil unit, and a primary coil unit. The secondary coil unit includes a secondary winding; and the primary coil unit includes a primary winding and an insulating portion. The insulating portion forms at least one through hole. At least one primary winding encircle at least one through hole and is wrapped by the insulating portion and fixed in the insulating portion. The magnetic core passes through at least one through hole. A shielding layer is formed on a surface of the insulating portion, and the shielding layer is used for connecting a safety ground and the electrical conductivity of the shielding layer is not more than 5000 S/m.

19 Claims, 15 Drawing Sheets

(51) Int. Cl.
*H01F 27/24* (2006.01)
*H01F 27/32* (2006.01)

(52) U.S. Cl.
CPC ..... *H01F 27/36* (2013.01); *H01F 27/363* (2020.08); *H01F 27/366* (2020.08)

(56) References Cited

U.S. PATENT DOCUMENTS 4,660,014 A 4/1987 Wenaas et al.
4,864,265 A * 9/1989 Peoples ..... H01F 27/363 336/5
6,187,410 B1 2/2001 Takahashi
6,445,269 B1 * 9/2002 Sylvain ..... H01F 41/127 336/84 R
9,640,314 B2 * 5/2017 Singh ..... H01F 27/23
2002/0057170 A1 5/2002 Skinner et al.
2006/0200971 A1 * 9/2006 Lanoue ..... H01F 27/327 336/122
2008/0211611 A1 * 9/2008 Hanov ..... H01F 27/363 336/60
2010/0085775 A1 * 4/2010 Niess ..... H01F 27/36 336/84 R
2010/0127815 A1 * 5/2010 Damnjanovic ..... H01F 27/289 336/84 C
2010/0301981 A1 12/2010 Zeng et al.
2013/0113598 A1 * 5/2013 Murillo ..... H01F 27/2885 29/605
2013/0127580 A1 * 5/2013 Dobbs ..... H01F 38/18 336/84 M
2014/0118946 A1 * 5/2014 Tong ..... H01F 27/322 361/704
2015/0028989 A1 * 1/2015 De Leon ..... H01F 27/36 29/606
2019/0096567 A1 * 3/2019 Zhang ..... H01F 27/36
2020/0075218 A1 * 3/2020 Nah ..... H01F 3/10

FOREIGN PATENT DOCUMENTS

CN 204946669 U 1/2016
JP S5882512 A 5/1983
JP 59074614 A * 4/1984 ..... H01F 27/362
WO 2015062838 A1 5/2015
WO WO-2015062838 A1 * 5/2015 ..... H01F 27/362

OTHER PUBLICATIONS

The Notice of Allowance dated Oct. 8, 2021 for U.S. Appl. No. 16/856,682.
The Non-final OA dated Feb. 21, 2020 by the USPTO.

* cited by examiner

HIGH-VOLTAGE TRANSFORMER AND ELECTRONIC POWER APPARATUS

CROSS REFERENCE

This application is a Continuation-In-Part application of U.S. Ser. No. 15/869,452, with filing date of Jan. 12, 2018, which is based upon and claims priority to Chinese Patent Application No. 201720104174.1, filed on Jan. 25, 2017, the entire contents thereof are incorporated herein by reference.

TECHNICAL FIELD

The present disclosure relates to a high-voltage transformer and an electronic power apparatus.

BACKGROUND

In an existing power distribution network, a high voltage, for example above 2 kV (kilovolt) in China, is subject to voltage decrease by means of a distribution transformer and then supplied to various loads for use. Therefore, in such a power distribution network, the distribution transformer is one of important parts. A traditional distribution transformer has many defects, for example, large size, heavy weight, great no-load loss, failed automatic isolation from fault, and susceptible to interference of power grid, etc.

At present, new technical solutions are sought in the industries. For example, a power electrode transformer (PET) is employed to replace a power frequency distribution transformer to remedy defects and implement high power density, miniaturization, high efficiency and intelligentization of a power distribution system. One core part of the PET is high-frequency high-voltage transformer, which is used for electrical energy conversion and electrical isolation between a high-voltage side and a low-voltage side.

Generally, the high-frequency high-voltage transformer is manufactured by the following three modes. In the first mode, the high-frequency high-voltage transformer may use air as main insulation against ground, which is similar to a power frequency dry-type transformer. However, larger insulation size is required because the insulation strength of air is relatively weak. The first mode is disadvantageous to the increase of power density. Also a high-voltage potential appears on the external surface of the transformer, so that it is required to take a safety distance into account. In the second mode, the high-frequency high-voltage transformer may use oil as main insulation against ground, which is similar to an oil-immersed transformer. However, in the second mode a shell and flammable insulating oil are required, and thus a potential safety hazard exists in an indoor environment. In the third mode, an integrated epoxy resin cast transformer is manufactured using a vacuum casting process, where a winding and a magnetic core are entirely cast into a resin. In case of an insulation fault, safety isolation is hard to make between the high-voltage side and the low-voltage side, and thus a potential safety hazard exists. Furthermore, a high voltage potential appears on the external surface of the transformer, so that it is required to take a safety distance into account, which is disadvantageous to the increase of power density.

The above-mentioned information disclosed in this Background section is only for the purpose of enhancing the understanding of background of the present disclosure and may therefore include information that does not constitute a prior art that is known to those of ordinary skill in the art.

SUMMARY

According to an aspect of the present disclosure, there is provided a high-voltage transformer, which includes a magnetic core, at least a secondary coil unit, and at least a primary coil unit. The secondary coil unit includes at least one secondary winding; and the primary coil unit includes at least one primary winding and an insulating portion. The insulating portion forms at least one through hole. The at least one primary winding encircle at least one through hole and is wrapped by the insulating portion and fixed in the insulating portion. The magnetic core passes through at least one through hole. A shielding layer is formed on a surface of the insulating portion, and the shielding layer is used for connecting a safety ground, an electrical conductivity of the shielding layer is not more than 5000 S/m (Siemens/meter).

According to another aspect of the utility model, there is provided a high-voltage transformer, which includes at least a secondary coil unit and at least a primary coil unit. The secondary coil unit includes at least one secondary winding; and the primary coil unit includes at least one primary winding and an insulating portion. The insulating portion forms at least one through hole. The at least one primary winding encircle at least one through hole and is wrapped by the insulating portion and fixed in the insulating portion. A shielding layer is formed on a surface of the insulating portion, and the shielding layer is used for connecting a safety ground, an electrical conductivity of the shielding layer is not more than 5000 S/m.

According to another aspect of the present disclosure, there is provided an electronic power apparatus, which includes a high-voltage transformer. The high-voltage transformer includes a magnetic core, a secondary coil unit, and a primary coil unit. The secondary coil unit includes at least one secondary winding. The primary coil unit includes at least one primary winding and an insulating portion. The insulating portion forms at least one through hole. The at least one primary winding encircle at least one of the through hole and is wrapped by the insulating portion and fixed in the insulating portion. The magnetic core passes through at least one of the through hole. A shielding layer is formed on a surface of the insulating portion, and the shielding layer is connected to a safety ground, an electrical conductivity of the shielding layer is not more than 5000 S/m.

BRIEF DESCRIPTION OF THE DRAWINGS

The above and other features and advantages of the present disclosure will become more apparent from the detailed description of exemplary embodiments with reference to the drawings, in which.

Figure 1:
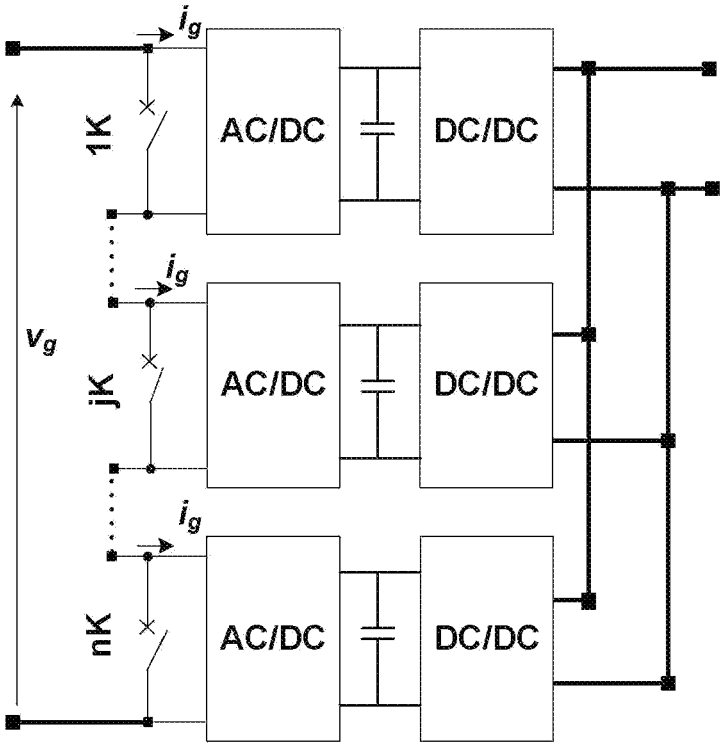
FIG. 1 is a circuit architecture diagram of a PET.

In the drawings, primary coil unit 11; shielding layer 101; insulating portion 102; primary winding 103; gap 1010; through hole 110; magnetic core 13; first column 131; second column 132; grounded terminal 20; secondary winding 201; and secondary coil unit 21.

DETAILED DESCRIPTION

Exemplary embodiments will be described more comprehensively by referring to accompanying drawings. However, the exemplary embodiments may be carried out in various manners, and shall not be interpreted as being limited to the embodiments set forth herein; instead, providing these embodiments will make the present disclosure more comprehensive and complete, and will fully convey the conception of the exemplary embodiments to those skilled in the art. Throughout the drawings, similar reference signs indicate the same or similar structures, and their detailed description will be omitted.

Figure 2:
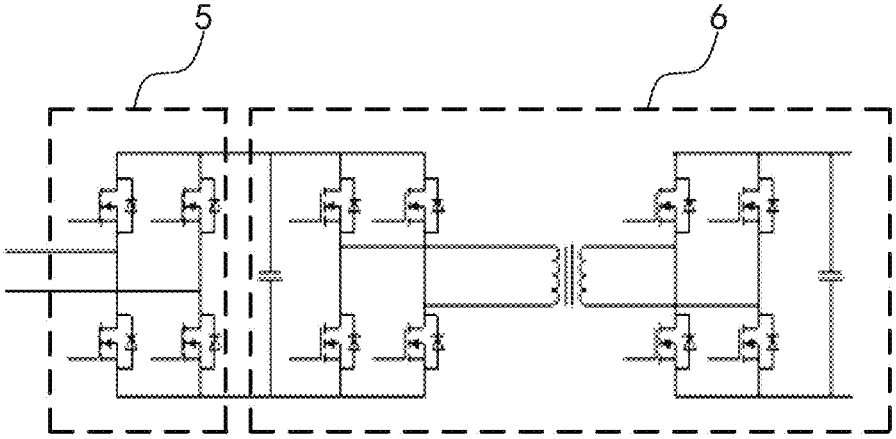
FIG. 2 is a schematic circuit diagram of a module in the circuit architecture diagram of the PET as shown in FIG. 1.

Reference is made to FIG. 1 and FIG. 2. As shown in FIG. 1, the PET is a multi-module input-series/output-parallel system architecture. The input current is marked as ig. Each module may include, for example, an AD/DC unit, a DC bus, and a DC/DC unit, which are sequentially connected. Bypass switches 1K to nK may be connected with the n modules. As shown in FIG. 2, the module includes cascade-connected AC/DC unit 5 and DC/DC unit 6. The DC/DC unit includes a core component, namely a high-frequency high-voltage transformer, which is used for electrical energy conversion and electrical isolation between a high voltage side and a low voltage side.

The High-Voltage Transformer According to the First Embodiment

Figure 3:
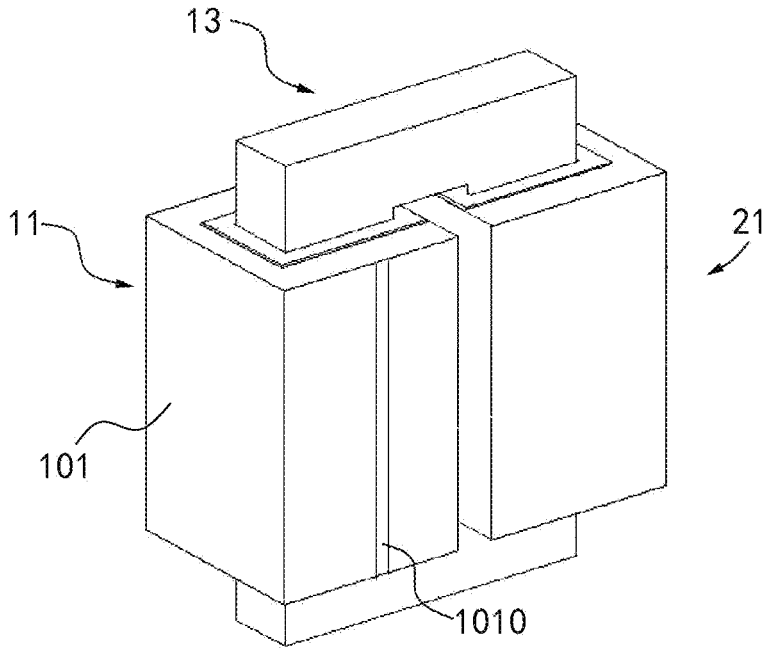
FIG. 3 is a perspective view of a high-voltage transformer according to a first embodiment of the present disclosure.
Figure 4:
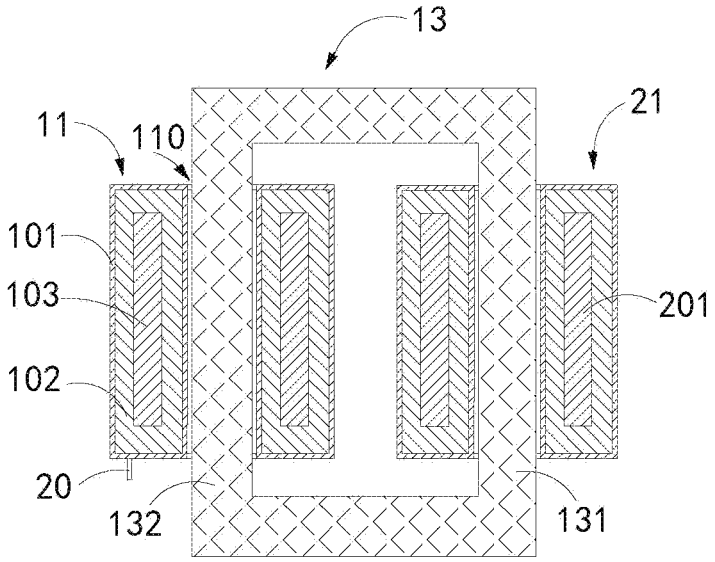
FIG. 4 is a cross-sectional view along the longitudinal direction of the high-voltage transformer as shown in FIG. 3.
Figure 5:
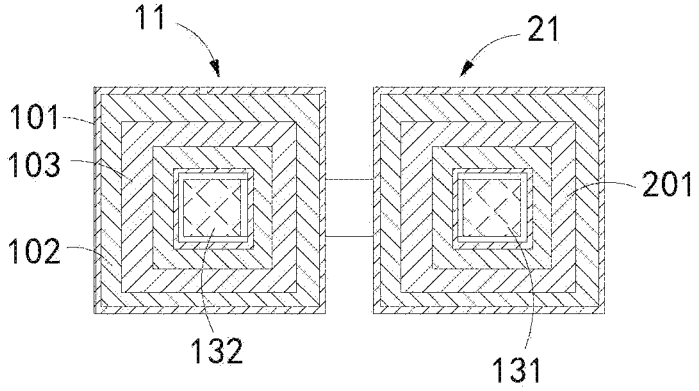
FIG. 5 is a cross-sectional view along the transversal direction of the high-voltage transformer as shown in FIG. 3.

Referring to FIG. 3, FIG. 4 and FIG. 5, FIG. 3 is a structural diagram of the high-voltage transformer according to the first embodiment of the present disclosure; FIG. 4 is a cross-sectional view along the longitudinal direction of the high-voltage transformer as shown in FIG. 3; and FIG. 5 is a cross-sectional view along the transversal direction of the high-voltage transformer as shown in FIG. 3. As shown in FIG. 3 to FIG. 5, the high-voltage transformer according to the first embodiment includes a primary coil unit 11, a secondary coil unit 21, and a magnetic core 13. The primary coil unit 11 includes a primary winding 103 and an insulating portion 102.

The insulating portion 102 may be made from an insulating material such as a resin, into which a through hole 110 is formed. In other embodiments, the number of the through hole 110 in the insulating portion 102 is not limited to one, which may be two or even more. The through hole 110 is configured to be passed through by the magnetic core.

The primary winding 103 encircles the through hole 110 and is wrapped by the insulating portion 102 and fixed in the insulating portion 102. A shielding layer 101 is formed on a surface of the insulating portion 102, and the electrical conductivity of the shielding layer is not more than 5000 S/m, which avoids local overheating or local oxidation and further reduces magnetic losses. A maximum voltage against ground of the primary coil unit 11 may be greater than 2 kV (kilovolt), for example, 3 kV, 6kV, 10 kV, 20 kV, and so on. The insulating portion is advantageous for designing voltage difference between the primary voltage and the secondary voltage. A ratio of the maximum voltage against ground of the primary coil unit 11 to a maximum voltage against ground of the secondary coil unit 21 may be not less than 5.

Figure 6:
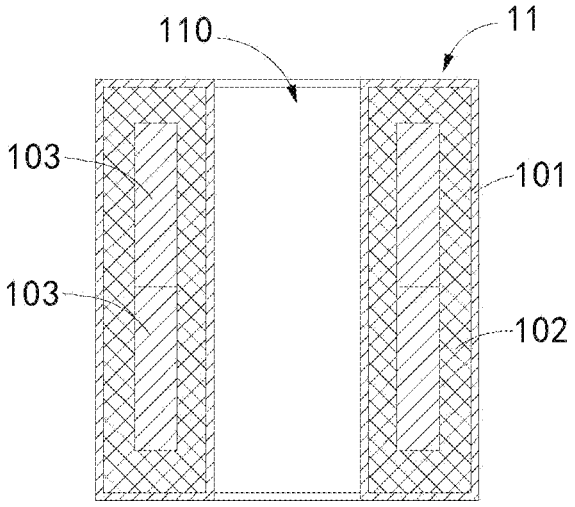
FIG. 6 is a cross-sectional view along the longitudinal direction of another structure of a primary winding in the high-voltage transformer as shown in FIG. 3.

Referring to FIG. 6, which is a cross-sectional view along the longitudinal direction of another structure of a primary winding unit in the high-voltage transformer as shown in FIG. 3, the primary coil unit 11 includes two series-connected primary windings 103. In the present disclosure, the number of the primary windings 103 in the primary coil unit 11 may be more than one, and a plurality of the primary windings 103 may be directly connected in parallel with each other, or directly connected in series with each other, or mutually independent and not directly connected with each other, but the present disclosure is not limited thereto.

The shielding layer 101 may cover all the surfaces of the insulating portion 102, including an internal surface (the surface surrounding through hole) and an external surface and so on. The shielding layer 101 also may cover a part of the surfaces of the insulating portion 102. Generally, to obtain a better shielding effect, the shielding layer 101 may cover more than 90% of the surface of the insulating portion 102. The shielding layer 101 may be a mixture consisting of a metal and an insulating material, or a mixture consisting of a carbon brazing and an insulating material, or a mixture consisting of a metal and a metal oxides. Also, the shielding layer may be made from 20% to 30% by weight of steel fiber and from 70% to 80% by weight of nylon, or from 25% to 35% by weight of carbon black and from 65% to 75% by weight of PPS (Phenylenesulfide) or from 15% to 25% by weight of Ti (Titanium) and from 75% to 85% by weight of $TiO_2$ (Titanium dioxide). For example, the shielding layer is made from 25% by weight of steel fiber and from 75% by weight of nylon, or from 30% by weight of carbon black and from 70% by weight of PPS, or from 20% by weight of Ti and from 80% by weight of $TiO_2$. The shielding layer has a thickness of 0.1-0.3 mm such as 0.2 mm and is formed on the surface of the insulating portion 102 by affixing, electroplating, evaporating, casting or spraying, etc. However, the present disclosure is not limited thereto.

The shielding layer 101 may be used for connecting a safety grounded point. The safety grounded point may be formed by, for example, a conductor buried into the ground, so as to reduce a high voltage potential of the primary coil unit and improve the safety performance of the high-voltage transformer. In some embodiments, for ease of connecting the safety ground, the shielding layer 101 is provided with an grounded terminal 20 (seeing FIG. 4). The grounded terminal 20 is used for connecting the shielding layer 101 to the safety ground in the form such as a surface-mounted grounded welding pad or a pin.

In some embodiments, the shielding layer 101 has a gap to prevent the shielding layer 101 from forming a closed conductive circuit. For example, the shielding layer 101 in FIG. 3 is provided with a gap 1010.

The secondary coil unit 21 may include at least one secondary winding 201, which may be directly connected in series with each other, or indirectly connected in series with each other, or directly connected in parallel with each other, or indirectly connected in parallel with each other, but the present disclosure is not limited thereto. In the first embodiment, the secondary coil unit 21 may be the same as the primary coil unit 11 in structure, including a secondary winding 201 which is fixed in and wrapped by an insulating material. The insulating material has a through hole, the secondary winding 201 encircles the through hole, and the insulating material may be entirely wrapped or partly covered with a shielding layer.

In the first embodiment, the magnetic core 13 includes a first column 131 and a second column 132. In other embodiments, the number of the column included in the magnetic core 13 is not limited to two. An air gap (not shown in the figure) may be arranged on the column or other positions the magnetic core 13. The number and position of the air gaps may be designed as needed.

The secondary coil unit 21 is arranged at the first column 131, that is, the first column 131 passes through the through hole of the secondary coil unit 21. The primary coil unit 11 is arranged at the second column 132, that is, the second column 132 passes through the through hole 110 of the primary coil unit 11.

In some embodiments, the primary coil unit 11 and/or the secondary coil unit 21 may be provided with pins passing through the shielding layer 101 for connecting the primary winding/secondary winding to other devices.

In the assembled high-voltage transformer, the primary coil unit 11, the secondary coil unit 21 and the magnetic core 13 may be exposed to air, so that heat dissipation mode is simplified, and heat dissipation effect is good.

In the first embodiment of the high-voltage transformer, the shielding layer 101 is electrically connected to the safety ground, so that a zero volt potential appears on the surface of the high-voltage transformer. Therefore, the safety performance is improved, and also other devices may be arranged nearby the primary coil unit 11, so that the high-voltage transformer is compact in structure, which is advantageous for enhancing power density and decreasing size. Furthermore, the high-voltage transformer also may be arranged nearby other devices, allowing the use to be more flexible and convenient.

Figure 15:
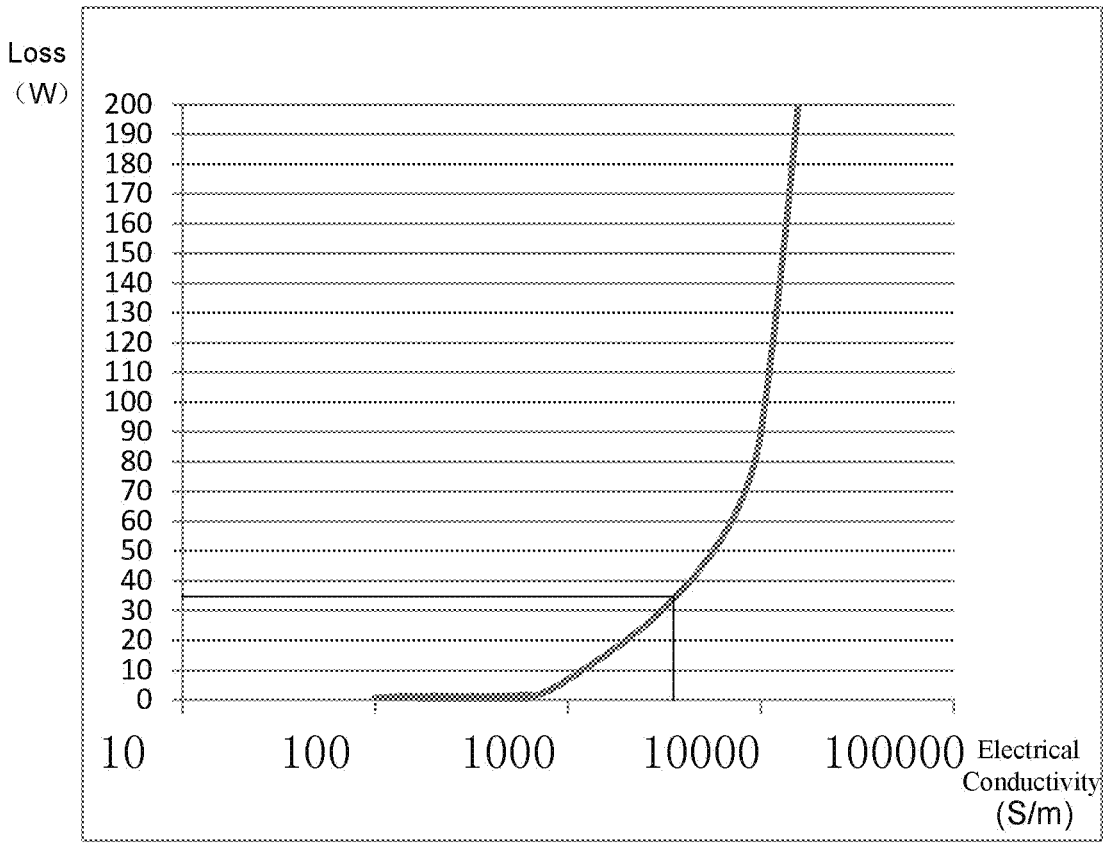
FIG. 15 is a diagram showing relationship between the electrical conductivity of the shielding layer and the magnetic losses of the high-voltage transformer.

Referring to FIG. 15, in one embodiment, in case that the electrical conductivity of the shielding layer is less 5000 S/m, the magnetic losses of the high-voltage transformer is below 30 W.

The High-Voltage Transformer According to the Second Embodiment

Figure 7:
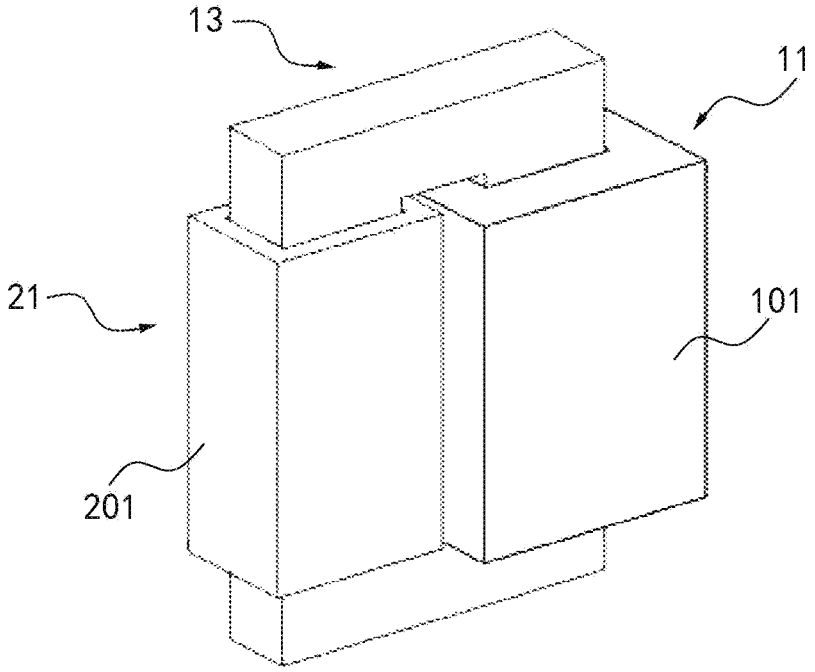
FIG. 7 is a structural diagram of a high-voltage transformer according to a second embodiment of the present disclosure.
Figure 8:
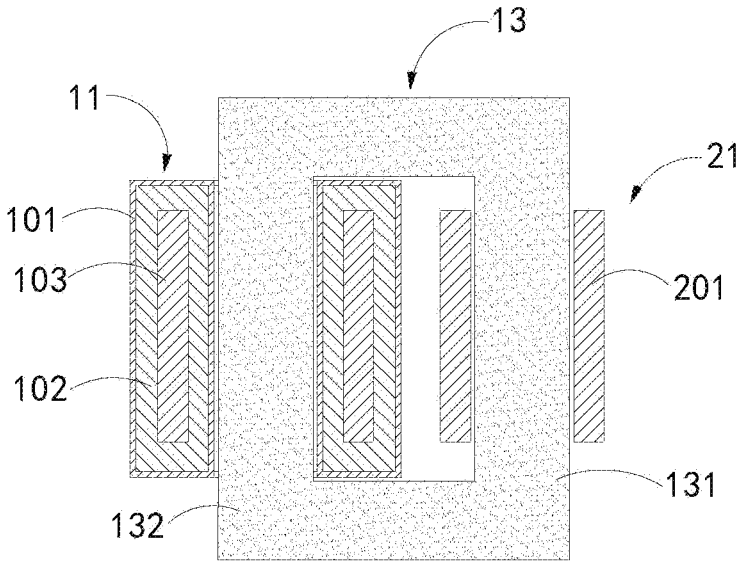
FIG. 8 is a cross-sectional view along the longitudinal direction of the high-voltage transformer as shown in FIG. 7.

Referring to FIG. 7 and FIG. 8, FIG. 7 is a structural diagram of the high-voltage transformer according to the second embodiment of the present disclosure; and FIG. 8 is a cross-sectional view along the longitudinal direction of the high-voltage transformer as shown in FIG. 7. As shown in FIG. 7 and FIG. 8, the difference between the high-voltage transformer according to the second embodiment and the high-voltage transformer according to the first embodiment mainly resides in that:

The secondary coil unit 21 may include a secondary winding 201 but not include the insulating portion and the shielding layer. The secondary coil unit 21 generally is at a low voltage and thus is relatively safe. Furthermore, when the secondary coil unit 21 does not include the insulating portion or the shielding layer, it is advantageous to enhancing power density and decreasing size of the high-voltage transformer. The size of the high-voltage transformer in this embodiment may be decreased to about 50% of that of a traditional high-voltage transformer.

Other structures of the high-voltage transformer according to the second embodiment are substantially the same as those of the high-voltage transformer according to the first embodiment, and thus their detailed descriptions are omitted herein.

The High-Voltage Transformer According to the Third Embodiment

Figure 9:
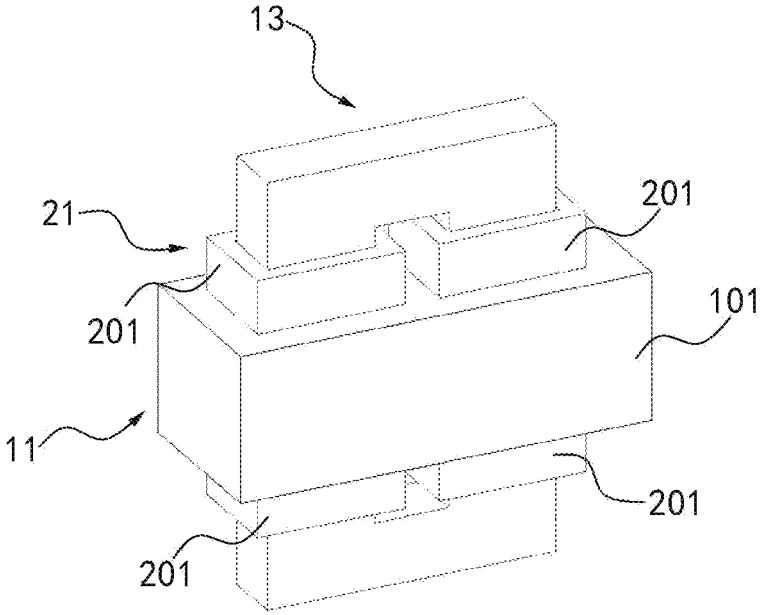
FIG. 9 is a structural diagram of a high-voltage transformer according to a third embodiment of the present disclosure.
Figure 10:
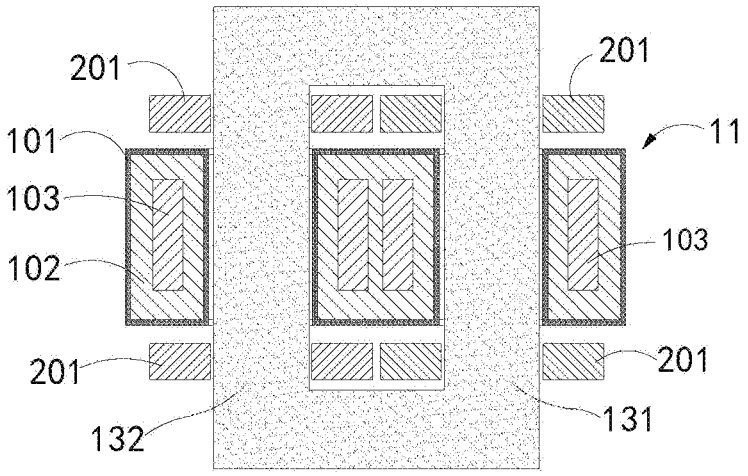
FIG. 10 is a cross-sectional view along the longitudinal direction of the high-voltage transformer as shown in FIG. 9.

Referring to FIG. 9 and FIG. 10, FIG. 9 is a structural diagram of the high-voltage transformer according to the third embodiment of the present disclosure; and FIG. 10 is a cross-sectional view along the longitudinal direction of the high-voltage transformer as shown in FIG. 9. As shown in FIG. 9 and FIG. 10, the difference between the high-voltage transformer according to the third embodiment and the high-voltage transformer according to the first embodiment mainly resides in that:

The primary coil unit 11 includes two through holes and two primary windings 103, where the two primary windings 103 in the insulating portion may be physically independent and not connected. The insulating portion 102 wraps and fixes the two primary windings 103 therein. The insulating portion 102 forms the two through holes, and the two primary windings 103 respectively encircle the corresponding through holes. However, in other embodiments, the two primary windings 103 may encircle the same through hole, the present disclosure is not limited thereto.

The first column 131 and the second column 132 of the magnetic core 13 respectively pass through the corresponding through holes. The two primary windings 103 may further be connected in parallel or series by outer connections.

The secondary coil unit 21 may include four mutually independent secondary windings 201, but may not include the insulating portion and the shielding layer. Two secondary windings 201 are wound around the first column 131 and positioned at two sides of the primary winding 103 of the primary coil unit, and a gap may be provided between the secondary winding 201 and the primary winding 103. The other two secondary windings 201 are wound around the second column 132 and positioned at two sides of the primary winding 103 of the primary coil unit, and a gap may be provided between the secondary winding 201 and the primary winding 103. An projection of the secondary winding 201 of the secondary coil unit on the magnetic core is not overlapped with that of the primary winding 103 of the primary coil unit on the magnetic core.

Figure 11:
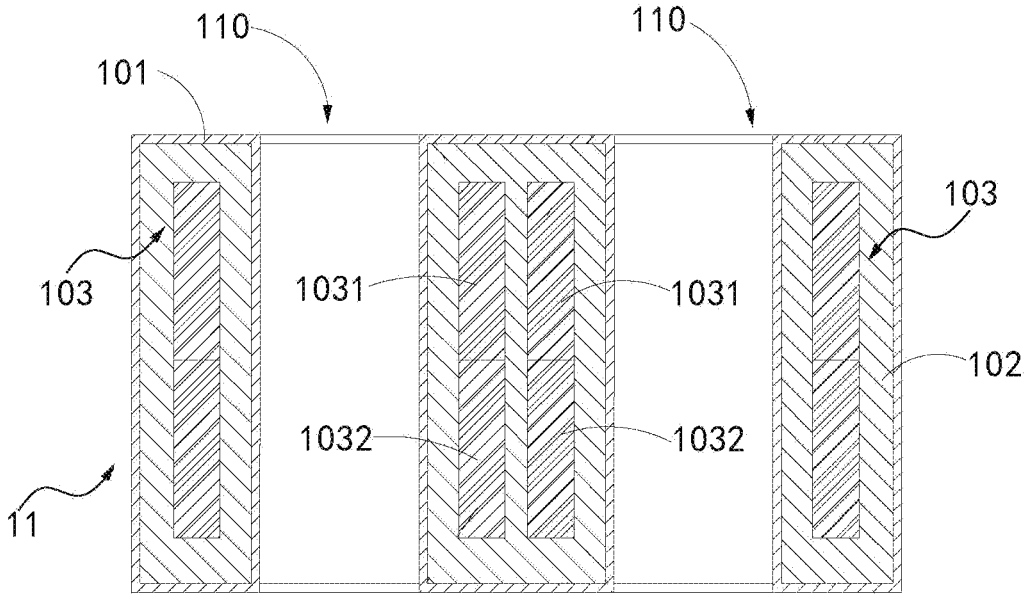
FIG. 11 is a cross-sectional view along the longitudinal direction of another structure of a primary winding in the high-voltage transformer as shown in FIG. 10.

The primary winding unit may have other structures. As shown in FIG. 11, FIG. 11 is a cross-sectional view along the longitudinal direction of another structure of a primary winding unit in the high-voltage transformer as shown in FIG. 10. As shown in FIG. 11, each of the primary windings 103 may further include two sub-windings 1031 and 1032 connected in series. Of course, the number of the sub-windings is not limited to two.

Other structures of the high-voltage transformer according to the third embodiment are substantially the same as those of the high-voltage transformer according to the first embodiment, and thus their detailed descriptions are omitted herein.

The High-Voltage Transformer According to the Fourth Embodiment

Figure 12:
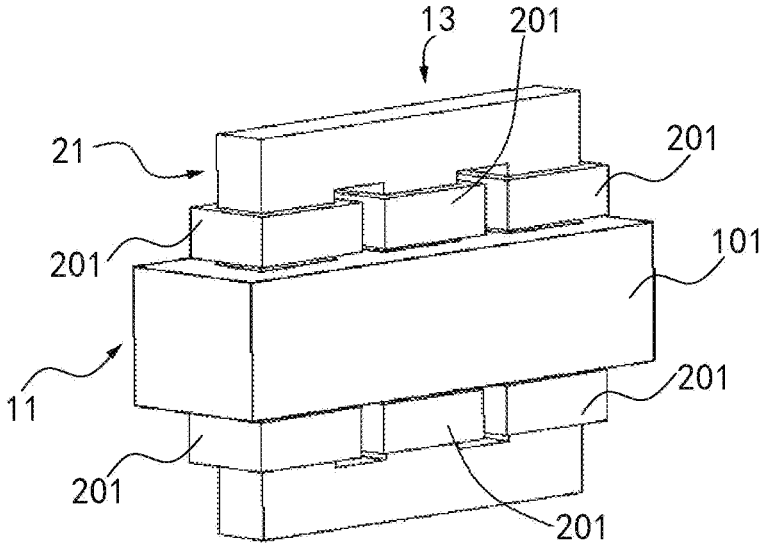
FIG. 12 is a structural diagram of a high-voltage transformer according to a fourth embodiment of the present disclosure.

Referring to FIG. 12, FIG. 12 is a structural diagram of the high-voltage transformer according to the fourth embodiment of the present disclosure. As shown in FIG. 12, the difference between the high-voltage transformer according to the fourth embodiment and the high-voltage transformer according to the third embodiment mainly resides in that:

the insulating portion of the primary coil unit 11 has three through holes, the primary coil unit 11 includes three primary windings arranged respectively surrounding around the three through holes; the secondary coil unit 21 includes three pairs of mutually independent secondary windings (i.e. six secondary windings); and the magnetic core 13 includes three columns, each of the columns passes through one corresponding through hole of the primary coil unit 11 and a pair of secondary windings, and each pair of secondary windings are arranged at two sides of the primary winding.

Other structures of the high-voltage transformer according to the fourth embodiment are substantially the same as those of the high-voltage transformer according to the third embodiment, and thus their detailed descriptions are omitted herein.

The High-Voltage Transformer According to the Fifth Embodiment

Figure 13:
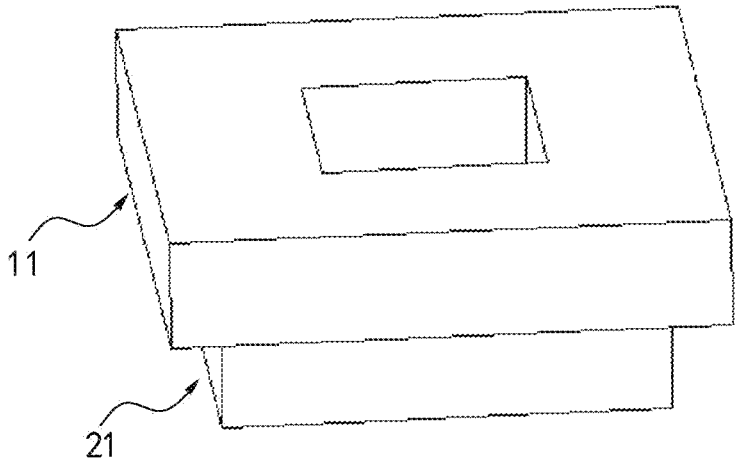
FIG. 13 is a structural diagram of the high-voltage transformer according to the fourth embodiment of the present disclosure.
Figure 14:
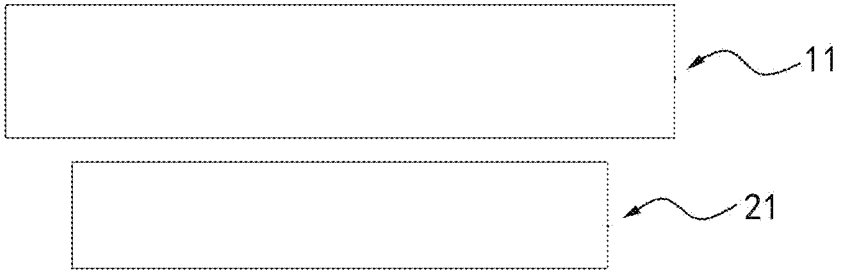
FIG. 14 is a front view of the high-voltage transformer as shown in FIG. 13.

Referring to FIG. 13 and FIG. 14, FIG. 13 is a structural diagram of the high-voltage transformer according to the fifth embodiment of the present disclosure; and FIG. 14 is a cross-sectional view along the longitudinal direction of the high-voltage transformer as shown in FIG. 13.

As shown in FIG. 13 and FIG. 14, the high-voltage transformer according to the fifth embodiment includes a primary coil unit 11 and a secondary coil unit 21. The primary coil unit 11 includes at least one primary winding 103 and an insulating portion 102. The insulating portion 102 forms at least one through hole 110, the at least one primary winding 103 encircle at least one of the through hole 110 and is wrapped by the insulating portion 102 and fixed in the insulating portion 102. The magnetic core 13 passes through at least one through hole 110. A shielding layer 101 is formed on the surface of the insulating portion 102, and the electrical conductivity of the shielding layer is not more than 5000 S/m. The shielding layer 101 is used for connecting a safety ground. The secondary coil unit 21 includes at least one secondary winding 201.

The primary coil unit 11 and the secondary coil unit 21 in the high-voltage transformer according to the fifth embodiment may be the same as those in the high-voltage transformer according to the foregoing embodiments. The high-voltage transformer according to the fifth embodiment does not include a magnetic core, and a magnetic field interlinks the primary winding and the secondary winding through air.

In the high-voltage transformer of the present disclosure, the primary winding of the primary coil unit is wrapped by the insulating portion and fixed in the insulating portion. That is, the insulating portion plays roles in fixing and insulating the primary winding, which is advantageous to improving the safety performance of the high-voltage transformer. Further, a shielding layer is formed on the surface of the insulating portion, and the shielding layer can be electrically connected to a safety ground, and the electrical conductivity of the shielding layer is not more than 5000 S/m, so that a high voltage potential of the primary coil unit is reduced, a low voltage potential or zero volt potential appears on the surface of the high-voltage transformer, and the safety performance of the high-voltage transformer is significantly improved. In another aspect, the low voltage potential or zero volt potential appears on the primary coil unit. Therefore, other parts such as the secondary coil unit or devices such as capacitors may be arranged nearby or even in direct contact with the primary coil unit, so that the power density can be significantly enhanced.

Electronic Power Apparatus

The electronic power apparatus of the present disclosure includes a high-voltage transformer. The high-voltage transformer includes a magnetic core, a primary coil unit, and a secondary coil unit. The secondary coil unit includes at least one secondary winding. The primary coil unit includes at least one primary winding and an insulating portion. The insulating portion forms at least one through hole. The at least one primary winding encircle the through hole and is wrapped by the insulating portion and fixed in the insulating portion. The magnetic core passes through at least one of the through hole. A shielding layer is formed on the surface of the insulating portion, and the shielding layer is connected to a safety ground, and the electrical conductivity of the shielding layer is not more than 5000 S/m.

In some other embodiments, the electronic power apparatus also may not include the magnetic core.

The shielding layer is connected to a safety ground, which reduces the potential on the surface of the electronic power apparatus or even reduces the potential to zero, thereby greatly improving the safety performance.

Relative terms such as "above" or "below" and "front" or "back" may be used in the above embodiments to describe a relative relation between one component and another component of an icon. It is to be understood that when the apparatus of the icon are turned upside down, components described as "above" or "below" and "front" or "back" will become components described as "below" or "above" and "back" or "front". The articles "a", "an", "the", and "at least one" are intended to mean that there are one or more element(s)/constituent part(s)/etc. The terms "comprising", "including" and "having" are intended to be inclusive and mean that there may be additional constituent part(s)/etc. other than the listed constituent part(s). Moreover, the terms "first" and "second" are used merely as labels, and are not intended to impose numerical requirements on their objects.

It is to be understood that the present disclosure is not limited in its application to the details of construction and the arrangement of the components set forth herein. The present disclosure may have other embodiments and can be implemented and carried out in various ways. Variations and modifications of the foregoing are within the scope of the present disclosure. It should be understood that the present disclosure disclosed and defined herein extends to all alternative combinations of two or more of the individual features mentioned or evident from the text and/or drawings. All of these different combinations constitute various alternative aspects of the present disclosure. The embodiments described herein explain the best modes known for practicing the present disclosure and will enable those skilled in the art to utilize the present disclosure.

What is claimed is:

1. A high-voltage transformer, comprising:

a magnetic core;

at least a secondary coil unit, comprising at least one secondary winding; and at least a primary coil unit, comprising at least one primary winding and an insulating portion, the insulating portion forming at least one through hole, the primary winding encircling the through hole and being wrapped by the insulating portion and fixed in the insulating portion, the magnetic core passing through the through hole, a shielding layer being formed on a surface of the insulating portion, and the shielding layer being used for connecting a safety ground, an electrical conductivity of the shielding layer is not more than 5000 S/m.

2. The high-voltage transformer according to claim 1, wherein the shielding layer covers more than 90% of the surface of the insulating portion.

3. The high-voltage transformer according to claim 1, wherein the shielding layer is a mixture consisting of a metal and an insulating material, or a mixture consisting of a carbon brazing and an insulating material, or a mixture consisting of a metal and a metal oxides.

4. The high-voltage transformer according to claim 1, wherein the shielding layer is made from 20% to 30% by weight of steel fiber and from 70% to 80% by weight of nylon, or from 25% to 35% by weight of carbon black and from 65% to 75% by weight of PPS, or from 15% to 25% by weight of Ti and from 75% to 85% by weight of $TiO_2$.

5. The high-voltage transformer according to claim 1, wherein the shielding layer has a thickness of 0.1-0.3 mm.

6. The high-voltage transformer according to claim 1, wherein the shielding layer is a conductive layer, and is formed on the surface of the insulating portion by affixing, electroplating, evaporating, pouring or spraying.

7. The high-voltage transformer according to claim 1, wherein the shielding layer is provided with a grounded terminal used for connecting the shielding layer to the safety ground.

8. The high-voltage transformer according to claim 1, wherein a maximum voltage against ground of the primary coil unit is greater than 2 kV, and a ratio of the maximum voltage against ground of the primary coil unit to a maximum voltage against ground of the secondary coil unit is not less than 5.

9. The high-voltage transformer according to claim 1, wherein the primary coil unit comprises a plurality of the primary windings, and the plurality of the primary windings are electrically connected in parallel or in series with each other.

10. The high-voltage transformer according to claim 1, wherein the magnetic core comprises a first column and a second column, the secondary coil unit is arranged at the first column, and the primary coil unit is arranged at the second column, wherein the number of the through hole formed by the insulating portion of the primary coil unit is one, and the second column passes through the through hole.

11. The high-voltage transformer according to claim 1, wherein the magnetic core at least comprises a first column and a second column, the number of the through hole formed by the insulating portion of the primary coil unit is at least two, and the first column and the second column respectively pass through the two through holes.

12. The high-voltage transformer according to claim 11, wherein the secondary coil unit is arranged at the first column and/or the second column.

13. The high-voltage transformer according to claim 11, wherein an projection of the secondary winding of the secondary coil unit on the magnetic core is not overlapped with that of the primary winding of the primary coil unit on the magnetic core.

14. The high-voltage transformer according to claim 11, wherein the primary coil unit comprises two primary windings, the two primary windings respectively encircle the two through holes; the secondary coil unit comprises four secondary windings, wherein two of the four secondary windings are arranged at two sides of the primary coil unit at the first column, and the other two of the four secondary windings are arranged at two sides of the primary coil unit at the second column.

15. The high-voltage transformer according to claim 1, wherein the shielding layer has a gap to prevent the shielding layer from forming a closed conductive circuit.

16. The high-voltage transformer according to claim 1, wherein the insulating portion is made from a resin.

17. The high-voltage transformer according to claim 1, wherein the primary coil unit comprises a plurality of the primary windings, and the plurality of the primary windings are not physically connected with each other in the insulating portion.

18. A high-voltage transformer, comprising:

a secondary coil unit, comprising at least one secondary winding; and a primary coil unit, comprising at least one primary winding and an insulating portion, the insulating portion forming at least one through hole, the at least one primary winding encircling the at least one through hole and being wrapped by the insulating portion and fixed in the insulating portion, a shielding layer being formed on a surface of the insulating portion, and the shielding layer being used for connecting a safety ground, an electrical conductivity of the shielding layer is not more than 5000 S/m.

19. An electronic power apparatus, comprising a high-voltage transformer, wherein the high-voltage transformer comprises:

a magnetic core;

a secondary coil unit, comprising at least one secondary winding; and a primary coil unit, comprising at least one primary winding and an insulating portion, the insulating portion forming at least one through hole, the at least one primary winding encircling the at least one through hole and being wrapped by the insulating portion and fixed in the insulating portion, the magnetic core passing through the at least one through hole, a shielding layer being formed on a surface of the insulating portion, and the shielding layer being connected to a safety ground, an electrical conductivity of the shielding layer is not more than 5000 S/m.

* * * * *